United States Patent [19]

Bohle

[11] Patent Number: 4,754,881

[45] Date of Patent: Jul. 5, 1988

[54] APPARATUS FOR CLASSIFYING OBJECTS ACCORDING TO THEIR LENGTHS

[76] Inventor: Lorenz Bohle, Im Luren 5, D-4722 Ennigerloh, Fed. Rep. of Germany

[21] Appl. No.: 905,676

[22] Filed: Sep. 9, 1986

[30] Foreign Application Priority Data

Mar. 18, 1986 [DE] Fed. Rep. of Germany ..... 3608989

[51] Int. Cl.[4] ..... B07C 5/06

[52] U.S. Cl. ..... 209/557; 209/586; 209/628; 209/686; 209/905

[58] Field of Search ..... 209/555, 557, 625, 628, 209/586, 589, 649, 565, 580, 905, 686

[56] References Cited

U.S. PATENT DOCUMENTS

| | | | |
|---|---|---|---|
| 3,327,850 | 6/1967 | Simmons | 209/644 |
| 3,455,444 | 7/1969 | Simmons et al. | 209/644 |
| 3,618,764 | 11/1971 | Bawduniak | 209/580 |
| 3,969,227 | 7/1976 | Garris | 209/565 |
| 4,082,189 | 4/1978 | Cordes | 209/587 |
| 4,379,509 | 4/1983 | Bohle | 209/625 |

*Primary Examiner*—James B. Marbert
*Attorney, Agent, or Firm*—Peter K. Kontler

[57] ABSTRACT

Apparatus for classifying elongated tablets, pills and similar objects according to their lengths has a rotary wheel-shaped conveyor with a peripheral groove which receives a succession of objects and advances them past a testing station where the objects are monitored by an optical reflection type detector which generates signals denoting the lengths of the objects. Such signals are used to expel by jets of compressed air those objects whose lengths are unsatisfactory ahead of the location where satisfactory objects leave the groove by gravity. The objects which approach and move past the testing station are attracted to the conveyor by suction.

20 Claims, 3 Drawing Sheets

APPARATUS FOR CLASSIFYING OBJECTS ACCORDING TO THEIR LENGTHS

BACKGROUND OF THE INVENTION

The present invention relates to improvements in apparatus for sorting or classifying objects according to their lengths. Objects which can be classified in the apparatus of the present invention can include pills, tablets and/or a variety of other objects having an elongated shape and a lenticular, oval, circular, elongated rod-shaped or other outline.

Commonly owned German Offenlegungsschrift No. 34 27 535 discloses a classifying apparatus wherein a magazine contains a supply of randomly intermixed satisfactory and defective objects. The objects are discharged into a composite conveyor comprising two successive vibratory chutes which deliver the objects to a first classifying apparatus. Objects having satisfactory widths and/or thicknesses are discharged onto a chute which delivers them onto the upper reach of an endless belt conveyor or into the circumferential groove of a wheel-shaped conveyor. Successive objects on the belt conveyor or in the groove of the wheel-shaped conveyor are monitored by an optical detector, and signals which are generated by the detector are used to expel (segregate) objects of unsatisfactory lengths.

U.S. Pat. No. 3,455,444 discloses an apparatus for classifying cucumbers according to their lengths. Successive cucumbers are advanced by two mutually inclined neighboring endless belt conveyors into the range of an optoelectrical detector which generates signals for deflection of cucumbers having different lengths in different directions. The arrangement is such that all very long cucumbers are deflected in one direction, all shorter cucumbers are deflected in another direction, and the shortest cucumbers are permitted or caused to advance along their original path. A drawback of the patented apparatus is that it cannot be used for proper classification of relatively small objects because it does not ensure adequate orientation of successive objects and reliable retention of objects in a preselected position and orientation during testing. Furthermore, the conveyors which are used in the patented apparatus tend to accumulate dust and other foreign matter which can adversely influence the accuracy of the testing operation if the testing operation involves monitoring radiation which is reflected by the conveyor or conveyors.

OBJECTS AND SUMMARY OF THE INVENTION

An object of the invention is to provide an apparatus which constitutes an improvement over and a further development of the apparatus described in my published German application.

Another object of the invention is to provide an apparatus which can classify a series of successive objects according to their lengths with a high degree of accuracy and which can reliably segregate satisfactory objects from defective objects.

A further object of the invention is to provide an apparatus wherein foreign matter, such as particles of dust or fragments of monitored articles, cannot adversely influence the accuracy of the testing operation.

An additional object of the invention is to provide an apparatus whose output is higher than the outputs of conventional apparatus and which is adjustable so that it can be used for classification of different types of objects.

A further object of the invention is to provide an apparatus which can be used as a superior substitute for conventional classifying apparatus in existing production lines for the making and processing of tablets, pills and other elongated objects.

Another object of the invention is to provide the apparatus with novel and improved means for properly holding the objects during testing.

A further object of the invention is to provide the apparatus with novel and improved means for segregating satisfactory objects from unsatisfactory objects.

The invention is embodied in an apparatus for classifying successive objects of a series of elongated objects according to their lengths, particularly for classifying tablets, pills and/or like commodities. The apparatus comprises a rotary classifying conveyor which can constitute or resemble a pulley or wheel and defines a circumferentially extending groove, a shaft or other suitable means for rotating the conveyor in a predetermined direction at a predetermined speed, means for admitting a series of randomly distributed shorter and longer objects into the groove at a first station adjacent the conveyor, means for monitoring successive objects in the groove and for generating signals denoting the lengths of monitored objects (such monitoring means is disposed at a second station downstream of the first station, as considered in the predetermined direction), means for pneumatically attracting the objects to the conveyor in the region of the second station, and means for expelling from the groove those objects whose monitoring has resulted in the generation of signals denoting objects having lengths outside of a preselected range of lengths.

The expelling means preferably includes a source of compressed gaseous fluid, channels which are provided in the conveyor and have discharge ends communicating with the groove radially inwardly of the objects in the groove, and a solenoid-operated valve or other suitable means for connecting the source of compressed gaseous fluid with at least one channel which is disposed radially inwardly of an object having a length outside of the preselected range.

The conveyor can comprise two coaxial disc-shaped members, and at least one of these members is preferably movable axially toward and away from the other member to hereby change the width of the groove and enhance the versatility of the apparatus.

The conveyor can be provided with a radiation reflecting surface in the groove, and the monitoring means can include a reflection type optoelectronic detector having means for directing a beam of radiation from the second station toward the reflecting surface so that the beam is reflected by the surface or by successive objects in the groove. The reflecting surface is preferably provided on a hub of one of the aforementioned coaxial disc-shaped members of the conveyor. The hub is surrounded by the groove between the two disc-shaped members.

The conveyor preferably comprises a first pair of mutually inclined annular surfaces which flank the inner annular portion of the groove, and a second pair of mutually inclined annular surfaces which flank the outer annular portion of the groove. The surfaces of each pair of surfaces diverge outwardly in a direction away from the axis of the conveyor, and the mutual inclination of surfaces of the second pair is more pronounced than the mutual inclination of surfaces of the first pair. Such configuration of the conveyor in the region of the groove facilitates proper orientation of objects which are about to reach the second station.

The aforementioned channels can be machined into or otherwise formed in one of the disc-shaped members, and their discharge ends communicate with the groove radially inwardly of the objects in the groove. The channels are preferably inclined and/or otherwise oriented or configurated in such a way that they can direct jets of compressed gaseous fluid (normally air) substantially radially outwardly against the adjacent objects in the groove. The expelling means of the apparatus further includes means for admitting compressed gaseous fluid into those channels which are located substantially radially inwardly of the objects whose monitoring has resulted in the generation of (unsatisfactory) signals denoting objects whose lengths are outside of the preselected range. The conveyor can be provided with at least two (for example, three) channels for each object in the groove, i.e., each defective object can be acted upon by two or more jets of air or another gaseous fluid.

The conveyor is preferably provided with a plurality of suction ports which communicate with the groove, and the means for attracting the objects in the groove to the conveyor comprises means for evacuating air from the ports in the region of the second station. The evacuating means can comprise a stationary suction chamber which is connected to the intake of a fan or another suitable suction generating device.

The conveyor can rotate about a substantially horizontal axis, and the second station is or can be located substantially at the twelve o'clock position of such conveyor. The expelling means is preferably located between the twelve and approximately four o'clock position of the conveyor. The apparatus preferably further comprises means (for example, an open-top receptacle) for receiving satisfactory objects from the groove downstream of the expelling means, for example, by gravity feed. The receiving means is preferably located between the expelling means and the seven o'clock position of the conveyor. The admitting means can include means for classifying the objects ahead of the conveyor according to at least one parameter (for example according to weight, width and/or thickness) other than the lengths of the objects.

If the objects are likely to be fragmentized in the course of admission into and/or during travel in the groove, the attracting means can include means for evacuating fragments of objects from the groove. To this end, the conveyor can be formed with the aforementioned suction ports which communicate with the groove, and the evacuating means then includes means for sucking air from the groove by way of the suction ports.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
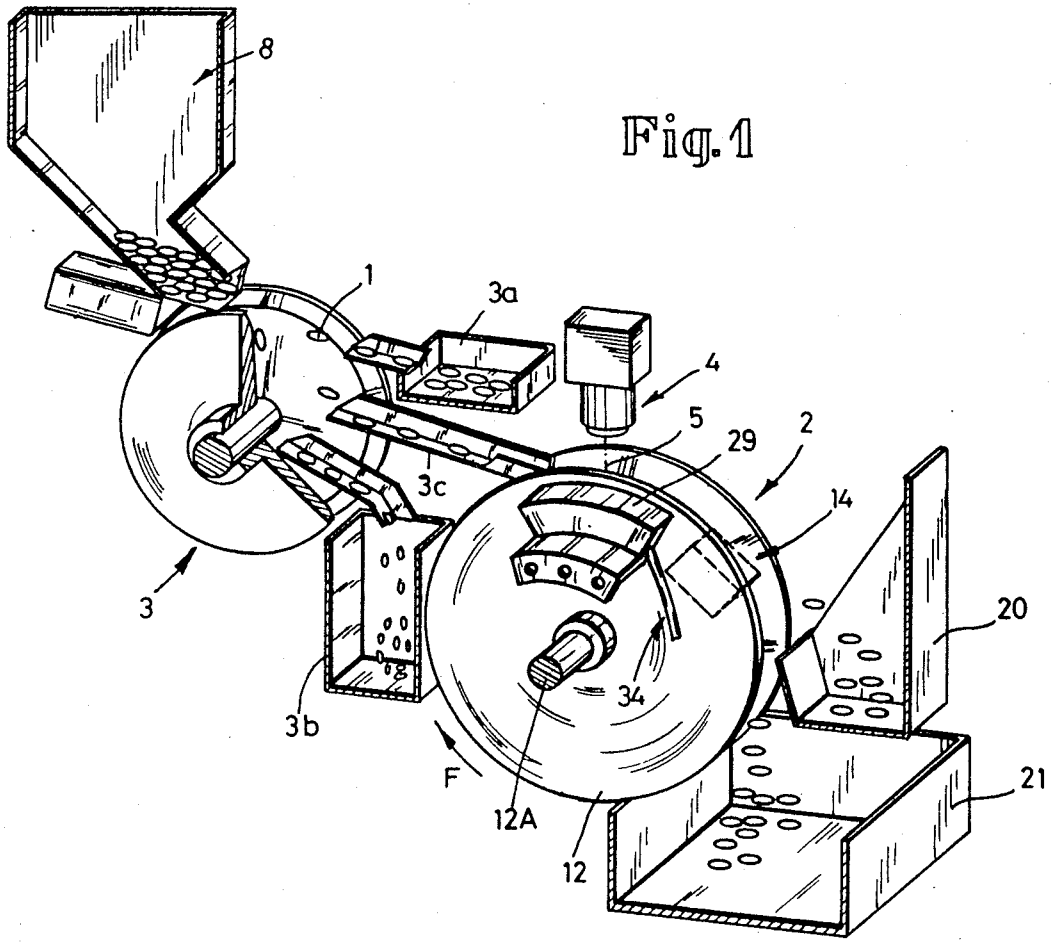
FIG. 1 is a partly sectional perspective view of a combination of apparatus for repeated classification of elongated objects and including an apparatus which embodies the present invention.

FIG. 1 shows a combination of apparatus which includes an apparatus 2 embodying one form of the invention. The combination comprises a magazine 8 which contains a supply of randomly distributed satisfactory and unsatisfactory objects 1, for example, tablets, pills and like commodities. The magazine 8 can contain objects which are too long or too wide and/or which otherwise deviate from a prescribed norm so that they must be segregated from satisfactory objects before the satisfactory objects are further processed, for example, introduced into vials, bottles or the like. The outlet at the lower end of the magazine 8 discharges a continuous stream or file of objects 1 into a conventional classifying apparatus 3 wherein the objects are classified according to their shapes. As shown in FIG. 1, apparatus 3 can classify objects according to three different parameters and unsatisfactory objects are admitted into different paths. Objects which are too large (e.g., too thick) are propelled into a first collecting receptacle **3*a* and the objects which are too small are admitted into a second collecting receptacle 3*b*. Those objects 1 which are satisfactory (except that they may be longer or shorter than desired) are discharged onto a ramp or chute 3*c* which admits the objects into a circumferential groove or gap 11 defined by two disc-shaped members 22, 23 of a pulley- or wheel-shaped conveyor 12 forming part of the apparatus 2. The ramp or chute 3*c* can be replaced by a driven conveyor or by any other suitable means for admitting a series of randomly distributed longer and shorter objects 1 into the grove 11, preferably at or close to the eleven o'clock position of the conveyor 12. The objects 1 on the conveyor 12 are classified according to their lengths and the conveyor 12 cooperates with an ejector or expelling means 14 to admit unsatisfactory objects into a first receptacle 20 while permitting all satisfactory objects to advance beyond the expelling means 14 and to descend by gravity into a further receptacle 21**.

The apparatus 2 further comprises means for monitoring the lengths of successive objects 1 which are admitted into the groove 11 of the conveyor 12. The latter is driven by a shaft 12A so that it rotates in the direction of the arrow F at a predetermined speed, preferably at a variable speed. The means for rotating the shaft 12A at one or more selected speeds is not specifically shown in the drawing. The monitoring means includes a reflection type optoelectronic detector 4 which is disposed at a testing or monitoring station at or close to the twelve o'clock position of the conveyor 12. The reference character 5 denotes a beam of radiation (for example, visible light) which is emitted by a light source of the detector 4 and is reflected by an object 1 or by a surface 27 on a cylindrical hub 25 of the disc-shaped member 23 at the bottom (i.e., in the deepmost portion) of the groove 11. The reflected beam 5 impinges upon the detector 4 regardless of whether it is intercepted by the object 1 in the adjacent portion of the groove 11 or by the surface 27 so that the detector can transmit a signal denoting the length (as measured in the circumferential direction of the groove 11) of the monitored object 1. The expelling means 14 is located downstream of the monitoring means, for example, between the twelve and four o'clock positions of the conveyor 12. The receptacle 21 can be located downstream of the expelling means 14 and preferably not beyond the seven o'clock position of the conveyor 12. In the illustrated apparatus, the receptacle 21 receives satisfactory objects 1 at or close to the five o'clock position of the conveyor 12.

The groove 11 includes an inner annular portion 11*a* and an outer annular portion 11*b*. The annular portion 11*a* is flanked by two mutually inclined annular surfaces 22*a*, 23*a* of the members 22, 23, and the annular portion 11*b* of the groove is flanked by the mutually inclined surfaces 22*b* and 23*b* of the members 22, 23. The angle between the annular surfaces 22*a*, 23*a* is smaller than the angle between the annular surfaces 22*b*, 23*b*. This allows for proper orientation of successive objects 1 which have entered the groove 11 ahead of the monitoring station at or close to the twelve o'clock position of the conveyor 12. A portion of the cylindrical hub 25 of the member 23 is partially surrounded by an internal surface 26 of the member 22. The member 22 and/or the member 23 is movable axially of the shaft 12A so as to increase or reduce the width of the groove 11 and to thereby enhance the versatility of the apparatus 2. The means for securing the member 22 and/or 23 in a selected axial position can comprise one or more screws or other suitable fastener means, not shown.

The surface 27 which reflects the beam 5 normally reflects radiation back into the detector 4. The width of the groove 11 will be altered if the admitting means 3*c* starts to deliver objects having a width or thickness other than that of the previously supplied objects.

Figure 3:
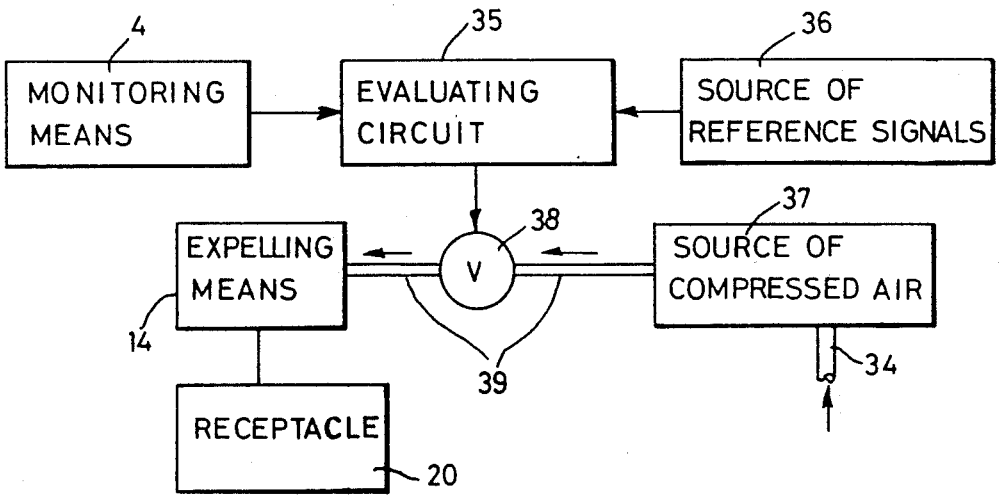
FIG. 3 is a diagram of the monitoring and expelling units in the improved apparatus.

In accordance with a feature of the invention, the apparatus 2 further comprises means for pneumatically attracting the objects 1 to the conveyor 12 during travel of objects from the discharge end of the admitting means 3*c* toward and past the monitoring or testing station. The attracting means includes an annulus of suction ports 31 which are machined into or otherwise formed in the disc-shaped member 22 at the level of the inner annular portion 11*a* of the groove 11. The outer side of the member 22 is in sealing contact with a suction chamber 29 having an arcuate groove 30 in register with the adjacent suction ports 31 so that the chamber 29 can draw air from the groove 11 to thereby attract the adjacent objects 1 to the surface 22*a* of the member 22. The outlet 28 of the suction chamber 29 is connected to a conduit 34 leading to a suction generating device. The suction generating device (see the device 37 of FIG. 3) can comprise a fan or the like. The pressure side of the fan 37 is or can be connected to the expelling means 14 to effect expulsion of unsatisfactory objects 1 from the corresponding portions of the groove 11 at the station for the receptacle 20. The means for maintaining the suction chamber 29 in adequate sealing contact with the outer side of the member 22 can include one or more springs or other suitable biasing means. If the member 22 is movable axially of the shaft 12A, such movements of the member 22 are shared by the suction chamber 29. The suction ports 31 are sufficiently close to each other to ensure that each object 1 which reaches the monitoring station is properly attracted to the member 22 while it advances toward and intercepts the beam 5 of radiation issuing from the detector 4. An evaluating circuit 35 (see FIG. 3) which is connected with the output of the detector 4 can discriminate between signals generated by radiation which is reflected by the surface 27 and signals which are generated in response to reflection of radiation by an object 1. The evaluating circuit 35 is further connected with a suitable source 36 of reference signals which can be compared with the signals transmitted by the signal generator 4, and the output of the circuit 35 transmits a signal when the freshly monitored object 1 has been found to be defective (too short or too long). The signal at the output of the evaluating circuit 35 is transmitted to a solenoid-operated valve 38 in a conduit 39 between the source 37 of compressed air and the expelling means 14. The expelling means 14 then effects expulsion of the corresponding object (which has caused the generation of a "defect" signal) into the receptacle 20. The exact mode of evaluating signals which issue from an optical detector and of using such signals for expulsion of defective objects from a series of randomly distributed satisfactory and unsatisfactory objects is known in many fields, for example, in the field of testing cigarettes and other rod-shaped articles of the tobacco processing industry. Therefore, the exact details of the evaluating circuit 35 and valve 38 need not be described here.

Figure 2:
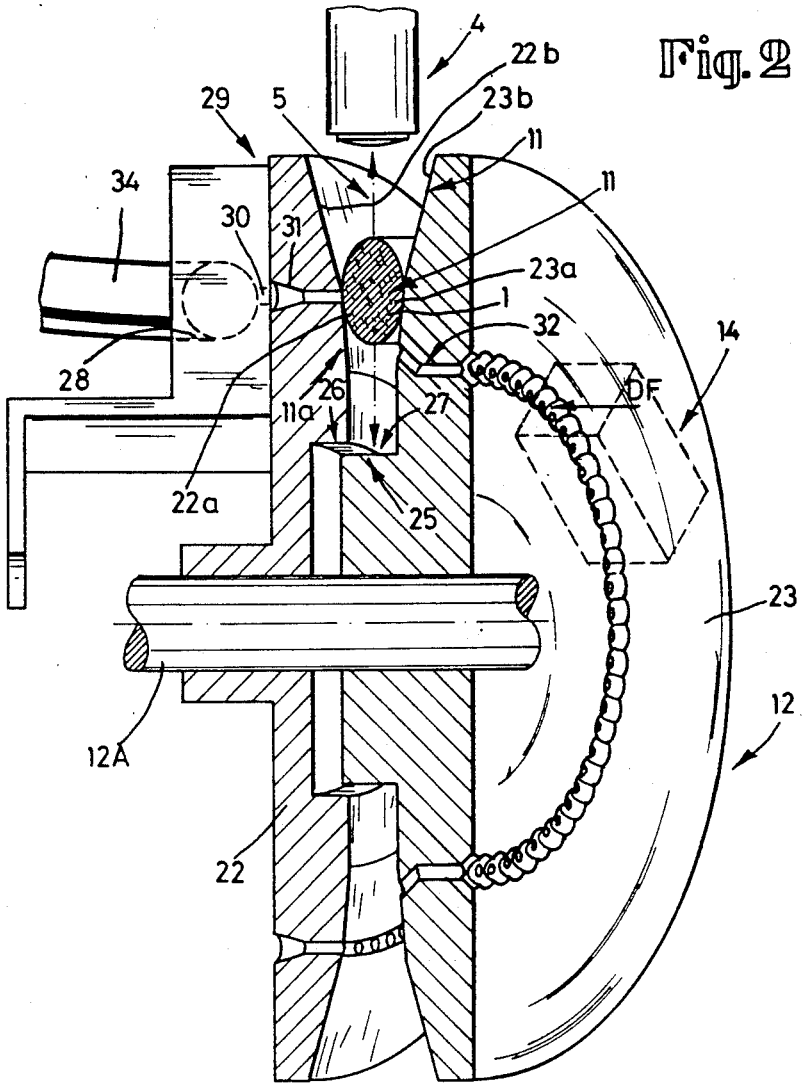
FIG. 2 is an enlarged partly vertical sectional and partly perspective view of the improved apparatus.

The disc-shaped member 23 is formed with an annulus of rather closely adjacent channels 32 having discharge ends communicating with the groove 11 radially inwardly of the surfaces 22*a* and 23*a*. The orientation of jets of compressed air which issue from the channels 32 is such that the jets can expel the adjacent defective objects 1 radially outwardly and into the receptacle 20 as soon as the defective objects arrive at the expelling station of the apparatus 2. The conduit 39 admits a stream of compressed air in the direction of the arrow DF which is shown in FIG. 2. Such stream is converted into jets which issue from the corresponding channels 32 and expel the defective object from the groove 11 good in time to ensure that the expelled object is intercepted by the receptacle 20. The expelling means 14 can comprise a stationary shoe which is adjacent a portion of the annulus of channels 32 at the outer side of the disc-shaped member 23 and has an inlet connected with the conduit 39. The arrangement is preferably such that the groove 30 of the suction chamber 29 terminates upstream or at the location where the oncoming channels 32 receive compressed air from the conduit 39. This ensures that the defective objects can be readily expelled from the corresponding portions of the groove 11 because they are no longer attracted by the adjacent suction port or ports 31. The suction intake of the source 37 of compressed air is or can be connected with the aforementioned conduit 34 which draws air from the suction chamber 29.

The suction chamber 29 and the suction ports 31 can perform another important and desirable function, especially if the objects 1 are likely to be chipped or otherwise fragmentized during admission into the groove 11 and during travel with the conveyor 12. Small fragments of objects 1 are drawn into the suction ports 31 and are evacuated into the suction chamber 29 where they can be intercepted by a suitable filter, sieve or the like to be evacuated at required intervals. An important advantage of evacuation of fragments of solid material from the groove 11 is that such fragments cannot deposit on the reflecting surface 27 and thus cannot interfere with accurate determination of the lengths of successive objects 1 in the groove 11.

The mode of operation of the apparatus 2 is as follows:

The admitting means 3c delivers a series of randomly distributed satisfactory and unsatisfactory objects 1 into the groove 11 ahead of the monitoring means. Such objects enter the narrower inner annular portion 11a of the groove 11 and are attracted to the disc-shaped member 22 of the conveyor 12 by the adjacent suction ports 31 which are then in register with the groove 30 of the suction chamber 29. The objects which penetrate radially inwardly of the groove 11 are properly oriented during travel along the outwardly flaring surfaces 22b, 23b which flank the outer annular portion 11b of the groove so that they are in proper positions for attraction by the adjacent suction ports 31 and for proper monitoring by the detector 4. The evaluating circuit 35 transmits to the valve 38 a signal whenever the detector 4 ascertains that the freshly monitored object 1 is too short or too long, and the valve 38 then permits compressed fluid medium (normally air) to flow from the source 37 into the expelling means 14 for an interval of time which suffices to ensure that the channels 32 which then register with the expelling means 14 discharge one or more jets of compressed fluid which propel the defective object radially outwardly and into the receptacle 20. As mentioned above, the groove 30 preferably terminates at or slightly ahead of the expelling means 14 so that a defective object which is about to be expelled from the groove 11 is no longer attracted to the disc-shaped member 22 of the conveyor 12.

Satisfactory objects 1 advance beyond the expelling means 14 and are discharged by gravity feed to enter the receptacle 21. It is equally within the purview of the invention to provide second expelling means (not shown) which responds to signals from the evaluating circuit 35 (namely to signals denoting satisfactory objects) to positively expel the satisfactory objects into the receptacle 21. In many instances, evacuation of satisfactory objects into the receptacle 21 by gravity feed alone suffices because the suction ports 31 which are adjacent the receptacle 21 are not in communication with the groove 30 of the suction chamber 29.

An important advantage of the improved apparatus is that the objects which are being tested are properly attracted to the conveyor 12 and cannot change their position and/or orientation during testing. Any shifting of position could entail the generation of signals denoting unsatisfactory objects in the case of objects having satisfactory lengths and vice versa.

The evaluating circuit 35 comprises suitable means (e.g., a shift register) for delaying the signals which are generated by defective objects 1 so that these objects reach the expelling station before the valve 38 opens.

In the appended claims, the term "elongated" is intended to denote objects whose length may but need not exceed their width. For example, the apparatus 2 can also monitor the lengths (diameters) of circular or substantially circular objects which are inserted into the groove 11 in such a way that they are elongated in the circumferential direction of the conveyor 12.

The apparatus can be used with equal or similar advantage for monitoring and classifying candies, cookies, fruits and/or other discrete objects which must be sorted according to their lengths.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for classifying successive objects of a series of elongated objects according to their lengths, particularly for classifying tablets, pills and the like, comprising a rotary classifying conveyor defining a circumferentially extending groove and having a radiation reflecting surface in said groove; means for rotating the conveyor in a predetermined direction at a predetermined speed; means for admitting a series of randomly distributed shorter and longer objects into said groove at a first station adjacent said conveyor; means for monitoring successive objects in said groove and for generating signals denoting the lengths of the monitored objects, said monitoring means being disposed at a second station downstream of said first station, as considered in said direction, and including a reflection type optoelectronic detector having means for directing a beam of rediation for said second station toward said reflecting surface so that the beam is reflected by said surface or by successive objects in said groove; means for pneumatically attracting the objects to said conveyor in the region of said second station; and means for expelling from said groove those objects whose monitoring has resulted in the generation of signals denoting the objects having lengths outside of a preselected range of lengths.

2. The apparatus of claim 1, wherein said expelling means includes a source of compressed gaseous fluid, channels provided in said conveyor and having discharge ends communicating with said groove radially inwardly of the objects in said groove, and means for connecting said source with at least one channel radially inwardly of an object having a length outside of said range.

3. The apparatus of claim 1, wherein said conveyor comprises two coaxial disc-shaped members and at least one of said members is movable axially relative to the other member to change the with of said groove.

4. The apparatus of claim 1, wherein said conveyor comprises two coaxial disc-shaped members one of which includes a hub surrounded by said groove, said reflecting surface being provided at the periphery of said hub.

5. The apparatus of claim 1, wherein said groove has an inner annular portion and an outer annular portion, said conveyor having a first pair of mutually inclined annular surfaces flanking said inner annular portion and a second pair of mutually inclined annular surfaces flanking said outer annular portion, the surfaces of each of said pairs diverging radially outwardly from the axis of said conveyor and the mutual inclination of the surfaces of said second pair being more pronounced than the mutual inclination of the surfaces of said first pair.

6. The apparatus of claim 1, wherein said conveyor has a plurality of channels having discharge ends communicating with said groove radially inwardly of objects in the groove and being arranged to direct jets of compressed gaseous fluid substantially radially outwardly against the adjacent objects in the groove, said expelling means including means for admitting compressed gaseous fluid into those channels which are located radially inwardly of objects whose monitoring has resulted in the generation of signals denoting objects having lengths outside of said range.

7. The apparatus of claim 6, wherein said conveyor has at least two channels for each object in said groove.

8. The apparatus of claim 1, wherein said conveyor has a plurality of suction ports communicating with said groove and means for evacuating air from said ports in the region of said second station.

9. The apparatus of claim 8, wherein said evacuating means comprises a stationary suction chamber.

10. The apparatus of claim 1, wherein said conveyor is arranged to rotate about a substantially horizontal axis and said second station is located substantially at the twelve o'clock position of said conveyor.

11. The apparatus of claim 10, wherein said expelling means is located between the twelve and approximately four o'clock positions of said conveyor.

12. The apparatus of claim 10, further comprising means for receiving satisfactory objects from said groove downstream of said expelling means.

13. The apparatus of claim 12, wherein said receiving means is located between said expelling means and the seven o'clock position of said conveyor.

14. The apparatus of claim 1, wherein said admitting means includes means for classifying the objects ahead of said conveyor according to at least one parameter other than the lengths of the objects.

15. The apparatus of claim 1 for classifying objects which are likely to fragmentize in the course of admission into and during travel in said groove, wherein said attracting means includes means for evacuating fragments of objects from said groove.

16. The apparatus of claim 15, wherein said conveyor has suction ports in communication with said groove and said evacuating means includes means for sucking air from said groove by way of said ports.

17. Apparatus for classifying successive objects of a series of elongated objects according to their lengths, particularly for classifying tablets, pills and the like, comprising a rotary classifying conveyor difining a circumferentially extending groove, said conveyor comprising two coaxial disc-shaped members and at least one of said members being movable axially relative to the other member to change the width of said groove; means for rotating the conveyor in a predetermined direction at a predetermined speed; means for admitting a series of randomly distributed shorter and longer objects into said groove at a first station adjacent said conveyor; means for monitoring successive objects in said groove and for generating signals denoting the lengths of the monitored objects, said monitoring means being disposed at a second station downstream of said first station, as considered in said direction; means for pneumatically attracting the objects to said conveyor in the region of said second station; and means for expelling from said groove those objects whose monitoring has resulted in the generation of signals denoting the objects having lengths outside of a preselected range of lengths.

18. The apparatus of claim 17, wherein said conveyor has a radiation reflecting surface in said groove and said monitoring means includes a reflection type optoelectronic detector having means for directing a beam of radiation from said second station toward said reflecting surface so that the beam is reflected by said surface or by successive objects in said groove.

19. Apparatus for classifying successive objects of a series of elongated objects according to their lengths, particularly for classifying tablets, pills and the like, comprising a rotary classifying conveyor defining a circumferentially extending groove, said groove having an inner annular portion and an outer annular portion, said conveyor having a first pair of mutually inclined annular surfaces flanking said inner annular portion and a second pair of mutually inclined annular surfaces flanking said outer annular portion, the surfaces of each of said pairs diverging radially outwardly from the axis of said conveyor and the mutual inclination of the surfaces of said second pair being more pronounced than the mutual inclination of the surfaces of said first pair; means for rotating the conveyor in a predetermined direction at a predetermined speed; means for admitting a series of randomly distributed shorter and longer objects into said groove at a first station adjacent said conveyor; means for monitoring successive objects in said groove and for generating signals denoting the lengths of the monitored objects, said monitoring means being disposed at a second station downstream of said first station, as considered in said direction; means for pneumatically attracting the objects to said conveyor in the region of said second station; and means for expelling from said groove those objects whose monitoring has resulted in the generation of signals denoting objects having lengths outside of a preselected range of lengths.

20. Apparatus for classifying successive objects of a series of elongated objects according to their lengths, particularly for classifying tablets, pills and the like, comprising a rotary classifying conveyor defining a circumferentially extending groove; means for rotating said conveyor in a predetermined direction at a predetermined speed; means for admitting a series of randomly distributed shorter and longer objects into said groove at a first station adjacent said conveyor, said conveyor having a plurality of channels having discharge ends communicating with said groove radially inwardly of objects in the groove and being arranged to direct jets of compressed gaseous fluid substantially radially outwardly against adjacent objects in the groove; means for monitoring successive objects in said groove and for generating signals denoting the lengths of the monitored objects, said monitoring means being disposed at a second station downstream of said first station, as considered in said direction; means for pneumatically attracting the objects to said conveyor in the region of said second station; and means for expelling from said groove those objects whose monitoring has resulted in the generation of signals denoting the objects having lengths outside of a preselected range of lengths, said expelling means including means for admitting compressed gaseous fluid into those channels which are located radially inwardly of objects whose monitoring has resulted in the generation of signals denoting objects having lengths outside of said range, said conveyor having at least two channels for each object in said groove.

* * * * *